US007469805B2

(12) United States Patent
Lynch

(10) Patent No.: US 7,469,805 B2
(45) Date of Patent: Dec. 30, 2008

(54) BOOT HANGER

(76) Inventor: Robert E. Lynch, 639 Tarpley La., Salem, VA (US) 24153

( * ) Notice: Subject to any disclaimer, the term of this patent is extended or adjusted under 35 U.S.C. 154(b) by 78 days.

(21) Appl. No.: 11/243,972

(22) Filed: Oct. 6, 2005

(65) Prior Publication Data

US 2007/0080181 A1 Apr. 12, 2007

(51) Int. Cl.
*A41D 27/22* (2006.01)

(52) U.S. Cl. ..... 223/85

(58) Field of Classification Search ..... 223/85–98; 211/34

See application file for complete search history.

(56) References Cited

U.S. PATENT DOCUMENTS

| | | | | | |
|---|---|---|---|---|---|
| D231,965 | S | | 7/1974 | Gutestam | |
| 4,669,615 | A | * | 6/1987 | Zigman | 211/34 |
| D357,813 | S | | 5/1995 | Koresko | |
| D368,167 | S | * | 3/1996 | Zeri | D6/317 |
| 5,950,882 | A | * | 9/1999 | Scott | 223/85 |
| 6,119,871 | A | * | 9/2000 | Mengel | 211/34 |
| D438,022 | S | * | 2/2001 | Bunn | D6/317 |
| 6,402,105 | B1 | * | 6/2002 | Hoyt et al. | 248/215 |
| 2005/0189383 | A1 | * | 9/2005 | Weal et al. | 223/85 |

OTHER PUBLICATIONS

"Boot Buddy™ Construction": Merrymeeting Ventures, 25 Oxbow Road, Dresden, ME 04342, USA; Copyright 1998.

* cited by examiner

*Primary Examiner*—Gary L Welch
*Assistant Examiner*—Andrew W Sutton
(74) *Attorney, Agent, or Firm*—Rabin & Berdo, PC

(57) ABSTRACT

The present invention is directed to a boot hanger which includes a hook and at least two spaced apart support arms. Each support arm includes a first section having a first end rigidly attached to a base of the hook and a second end disposed distal from the hook. The first section extends at a downward slope from the base of the hook, so that when the hook is disposed to be a high point of the hanger, the second end is disposed lower than the first end. Further, the support arms include a second section having a first end connected to the second end of the first section, and a second end disposed in a region approximately under the hook. The first sections of the support arms angle away from each other to collectively form an acute angle, with the vertex of the acute angle being at a base of the hook. The second sections of the support arms are spaced apart from each other at a generally constant distance, and are generally parallel to each other.

18 Claims, 5 Drawing Sheets

Fig. 4
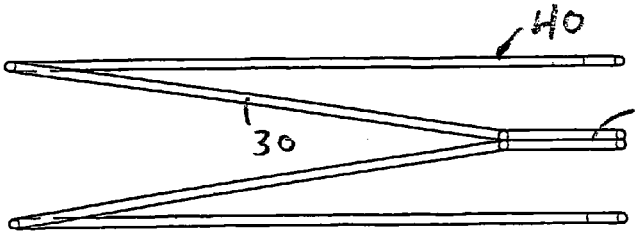
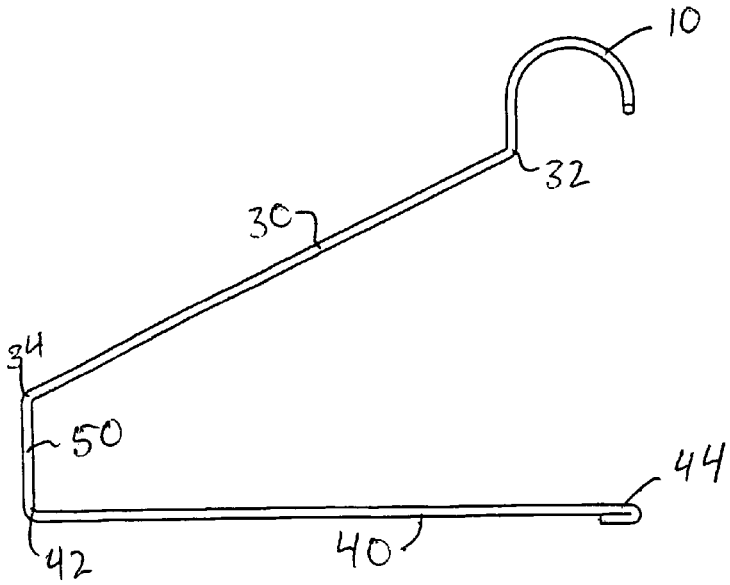
Fig. 2
Fig. 3
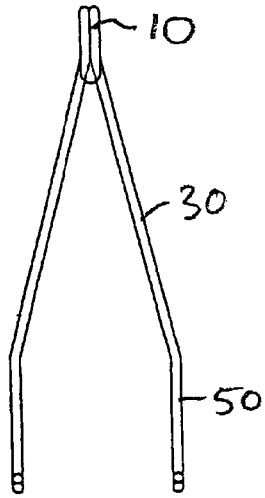

BOOT HANGER

BACKGROUND OF THE INVENTION

Hip wader boots are utilized by fishermen, for example, when wading into streams and other shallow bodies of water in order to keep their legs dry. Hip wader boots are typically characterized as having a relatively long neck that extends up the user's leg to cover the user's feet, calves and thighs. The necks are relatively flexible and non-rigid, so that they are typically held up in place utilizing suspenders or belts. However, the long flexible neck of the hip wader boot presents several problems. For example, because the neck is not rigid, the boot can not be stored in an upright position. That is, even if the sole of the boot is placed on the ground, the neck of the boot will flop to the side, so that the neck opening will be disposed on the ground. This causes the boot to take up a larger amount of storage space. Moreover, since the neck will be on the ground, when not in use and while the fisherman is in the field, various creatures, such as insects or the like, can crawl into the boot. Further, if the boots are stored in the user's home, for example on the closet floor, dry rot can occur at the various creases, which can subsequently lead to leaks into the boot, rendering the boot defective.

Alternatively, it is also known to hang the boot from a conventional metal hanger. However, when the boot is hung from the metal hanger, the boot is typically draped over the horizontal wire of the hanger, causing a crease to be formed in the neck of the boot, which again can lead to dry rot and leaks. Moreover, it is also easy for the boot to slip off the hanger when hung in such a manner, so that the boot will end up on the floor or on the ground. Moreover, the conventional metal hanger typically does not have the strength to hold the hip wader boot. Additionally, the conventional metal hanger is not adapted to be utilized in the field, and is also subjectable to corrosion, which can stain the boot.

Furthermore, because the boot will be folded over the conventional metal hanger, any water that may have found its way into the boot will be prevented from draining from the base of the boot if the boot is hung to dry. This is because the fold in the boot, which is formed at the horizontal wire of the hanger, will be positioned at a location higher than the sole of the boot, and will additionally effectively seal any water in the foot of the boot therein.

Thus, it is an objective of the present invention, to provide a boot hanger which will hold the boot in an inverted position to facilitate drainage therefrom, and which will facilitate storage of the boot both in and out of the field (i.e., out-of-doors).

SUMMARY OF THE INVENTION

It is, therefore, a principal object of this invention to provide a boot hanger.

It is another object of the invention to provide a boot hanger that solves the above mentioned problems.

These and other objects of the present invention are accomplished by the boot hanger disclosed herein.

The present invention is directed to a boot hanger which includes a hook and at least two spaced apart support arms. Each support arm includes a first section having a first end rigidly attached to a base of the hook and a second end disposed distal from the hook. The first section extends at a downward slope from the base of the hook, so that when the hook is disposed to be a high point of the hanger, the second end is disposed lower than the first end. Further, the support arms include a second section having a first end connected to the second end of the first section, and a second end disposed in a region approximately under the hook. The first sections of the support arms angle away from each other to collectively form an acute angle, with the vertex of the acute angle being at a base of the hook. The second sections of the support arms are spaced apart from each other at a generally constant distance, and are generally parallel to each other.

BRIEF DESCRIPTION OF THE DRAWINGS

FIG. 2 is a side view of an exemplary aspect of the boot hanger according to the present invention.

FIG. 3 is a front view of the boot hanger shown in FIG. 2.

FIG. 4 is a top-down view of the boot hanger shown in FIG. 2.

DETAILED DESCRIPTION OF THE INVENTION

The invention will now be described in more detail by way of example with reference to the embodiments shown in the accompanying Figures. It should be kept in mind that following described embodiments are only presented by way of example and should not be construed as limiting the inventive concept to any particular physical configuration. Further, if used and unless otherwise stated, the terms "upper", "lower", "front", "back", "over", "under", and similar such terms are not to be construed as limiting the invention to a particular orientation. Instead these terms are used only on a relative basis.

Referring generally to FIGS. 1 through 5, the present invention is directed to a boot hanger 1. The boot hanger 1 is adapted to have a boot, for example, a hip wader boot, accommodated therein. However, it is contemplated that the hanger according to the present invention can also be utilized to accommodate other forms of footware, without departing from the spirit and scope of the present invention.

Figure 1:
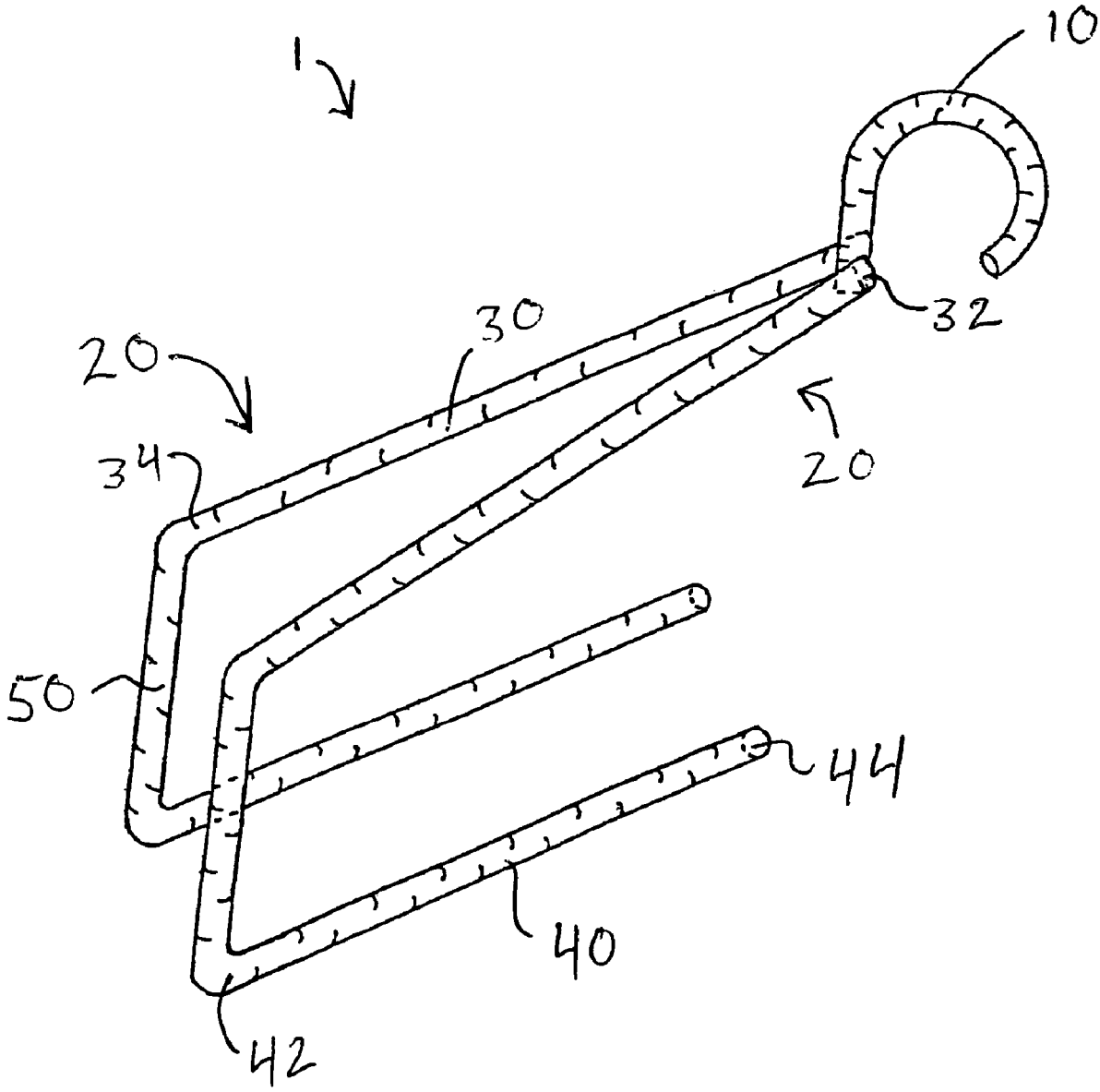
FIG. 1 is a prospective view of an exemplary aspect of the boot hanger according to the present invention.
Figure 5:
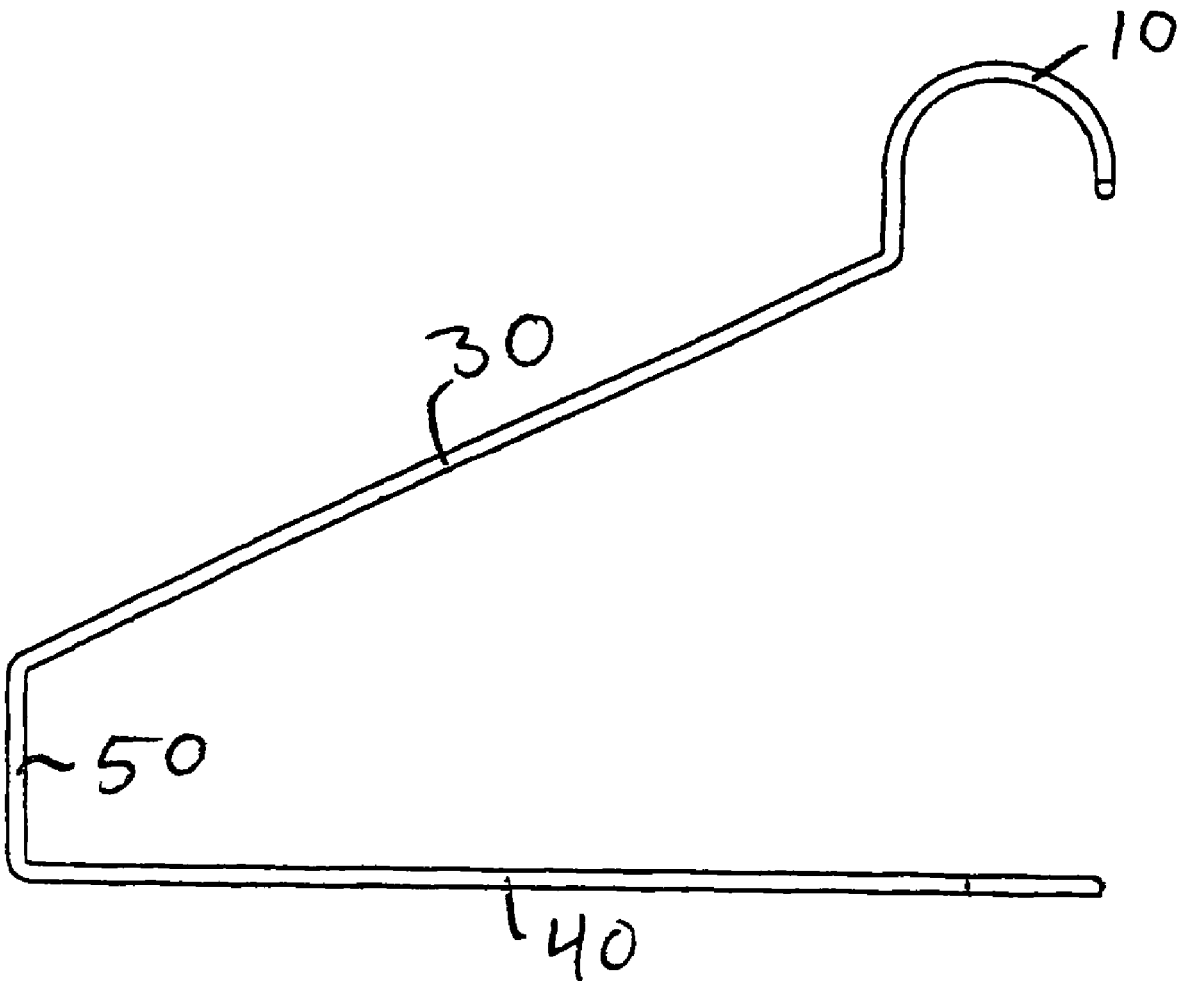
FIG. 5 is a side view of another exemplary aspect of the boot hanger according to the present invention.

The hanger 1 includes a hook 10 and at least two spaced apart support arms 20. Each support arm 20 includes a first section 30. As shown in FIG. 1, the first section 30 has a first end 32 rigidly attached to a base of the hook 10. The first section 30 also includes a second end 34 disposed distal from the hook 10. The first section 30 extends at a downward slope from the base of the hook 10, so that when the hook is disposed to be at a high point of the hanger 1, the second end 34 is disposed lower than the first end 32.

Moreover, each support arm 20 further includes a second section 40 having a first end 42 connected to the second end 34 of the first section 30. The second section 40 also includes a second end 44 disposed in a region approximately under the hook 10.

As best shown in FIG. 3, the first sections 30 of the support arms 20 angle away from each other to collectively form an acute angle, with a vertex of the acute angle being at a base of the hook 10. Moreover, and as best shown in FIG. 4, the second sections 40 of the support arms 20 are spaced away from each other at a generally constant distance, and are generally parallel to each other. It is noted that exact spacing and parallelism are impossible to achieve. Thus, slight variations in the spacing between the second sections 40 of the support arms 20 and the parallelisms therebetween are to be expected, and are within the spirit and scope of the present invention.

As best shown in FIGS. 1 and 2, each support arm 20 may further include a third section 50 which directly connects the respective first sections 30 with the respective second sections 40. When the third sections 50 are formed to be essentially straight, then in a preferred aspect of the invention, the third sections will form a right angle with the respective second sections 40, and an acute angle with the respective first sections 30. However, it is also contemplated that the third sections 50 can have a curved shape, with one end of the curve being connected to the first section 30 and another end of the curve being connected to the second section 40. The third section advantageously spaces the first section 30 away from the second section 40, so as to allow the heel of a boot to be accommodated therein.

As shown, the first section 30 and the second section 40 are essentially straight. However, slight curvatures in the configuration of the sections are also within the spirit and scope of the claimed invention.

Moreover, in a preferred aspect of the present invention, when the second sections 40 are disposed in a horizontal plane, as shown in FIG. 2, the hook 10 will be positioned so that an opening defined thereby will be facing the horizontal plane. This configuration will allow the hanger to be in its proper orientation when the hanger is hung, and accommodating a boot.

In a preferred aspect of the present invention, the hook 10 and the support arms 20 are comprised of stainless steel, for example, one quarter inch diameter stainless steel. By forming the hook and the support arms of stainless steel, the hanger will be resistant to corrosion, so that the hanger can be utilized with wet boots, and in the out-of-doors, without risk of corrosion. However, it is also contemplated that the hanger can be formed of other metals or materials without departing from the spirit and scope of the invention.

As best shown in FIG. 4, the hook 10 and the support arms 20 may be formed from a continuous, bent steel rod. This allows the hanger to be made without requiring separate attachment operations, which would otherwise be required to connect the hook 10 to the support arms 20. However, it is also contemplated that the hook 10 can be rigidly fastened to the support arms 20, for example, by welding, such as shown in FIG. 1.

Figure 6:
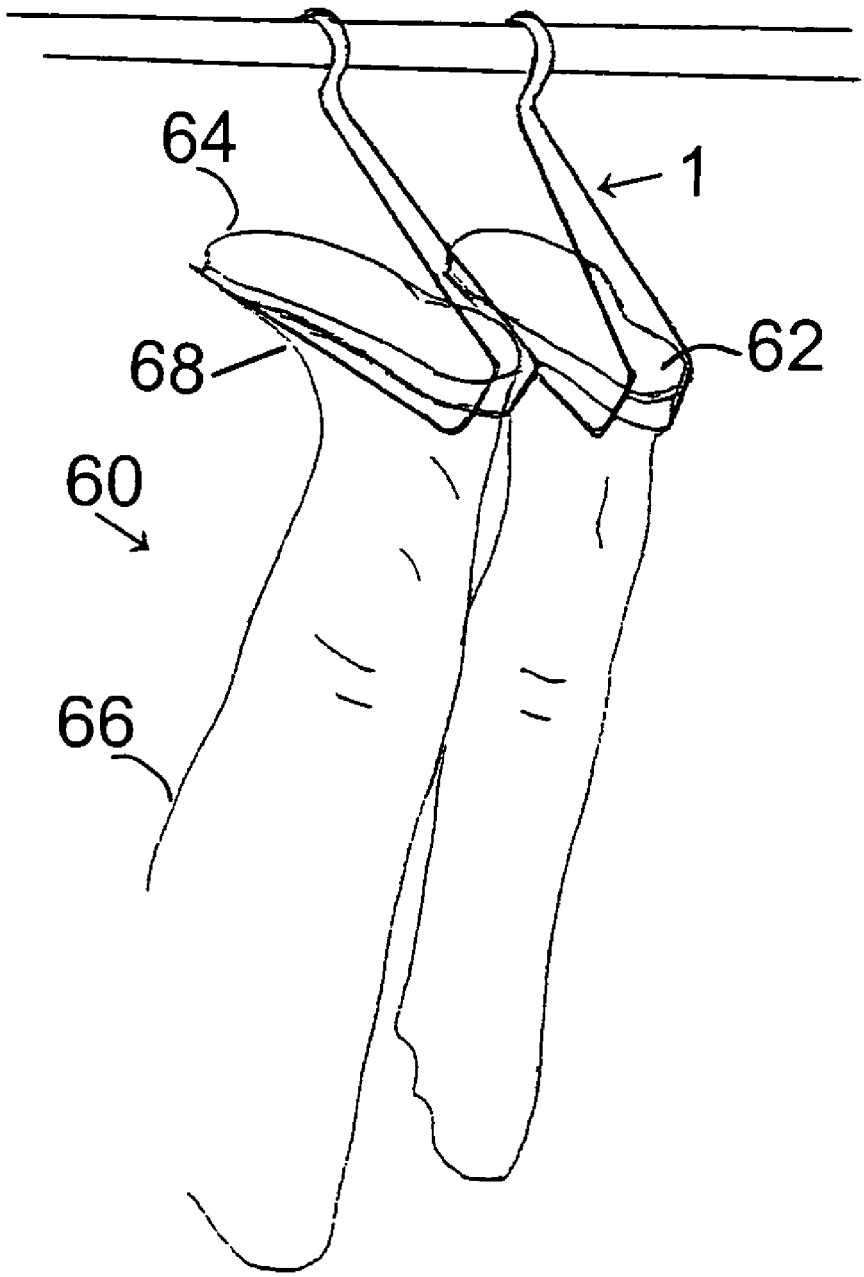
FIG. 6 illustrates two boot hangers according to the present invention being utilized indoors, to hang two hip wader boots.
Figure 7:
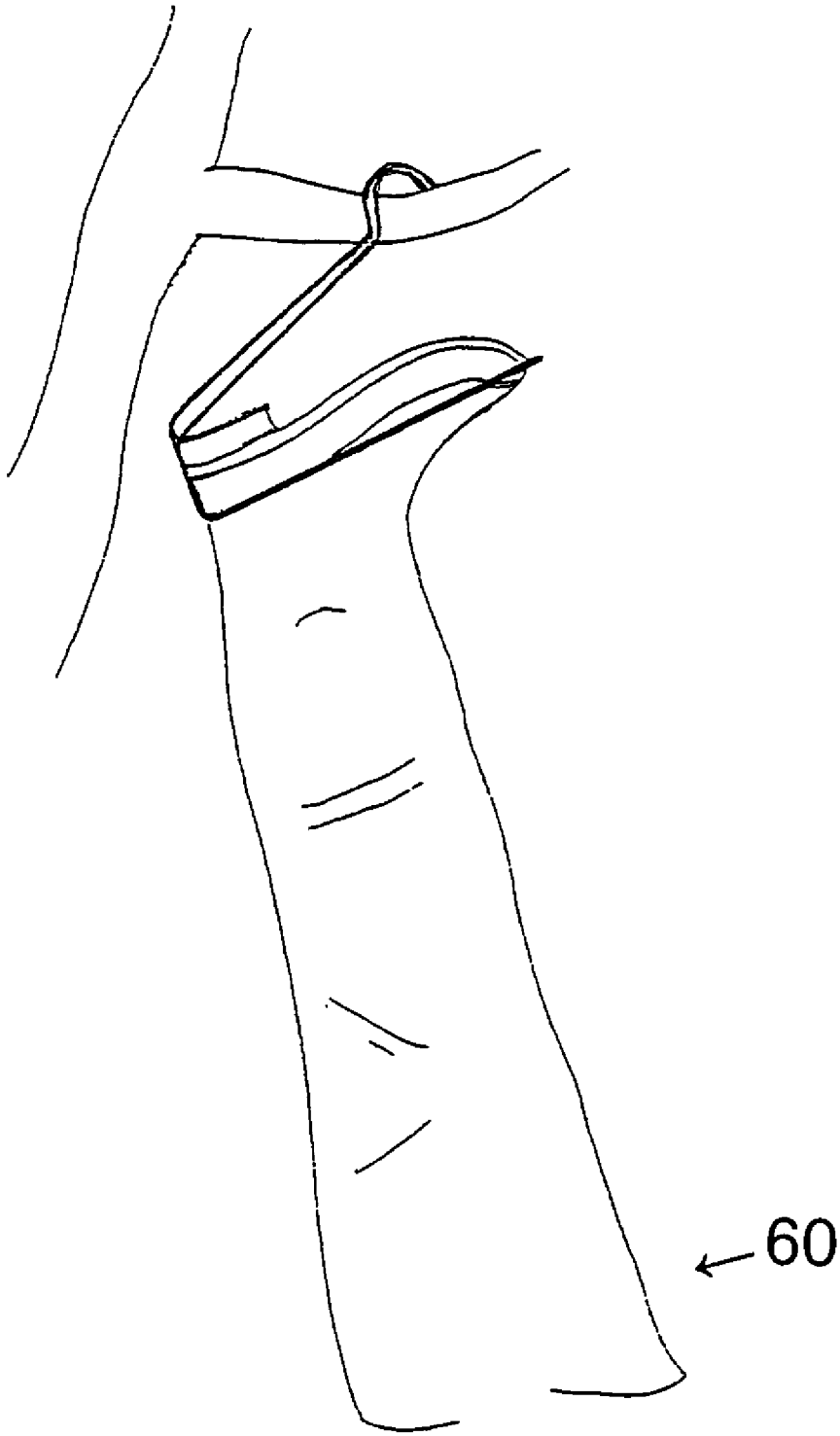
FIG. 7 shows the boot hanger according to the present invention being utilized outdoors, to hang a hip wader boot.

Referring to both FIGS. 6 and 7, when the hanger 1 is freely hanging, a region of the support arms 20 where the first sections 30 are connected to the second sections 40 is disposed lower than the second ends 44 of the second sections 40. Because of this arrangement, when an inverted boot 60 is accommodated within the support arms 20, the heel 62 of the boot will be positioned lower than the toe 64 of the boot. This will facilitate drainage from the inside of the boot.

As shown best in FIGS. 6 and 7, the heel 62 of the boot is positioned in a region where the second section 40 is connected to the first section 30 and immediately adjacent to the third section 50. With this arrangement, the toe 64 of the boot will be positioned in a region of the second ends 44 of the second sections 40, with the neck 66 of the boot extending downward between the respective second sections, and with the second sections engaging and supporting an upper 68 of the boot 60.

Due to the somewhat flexible nature of the steel rod, the second sections 40 can be flexed away from each other. This will allow the distance therebetween to be increased, so as to accommodate boots of different sizes.

Although the dimensions of the hanger can be modified to meet the needs of the user, it has been discovered that the following dimensions are particularly advantageous when the hanger is utilized to accommodate an inverted hip wader boot. In an exemplary aspect of the invention, the second sections 40 of the support arms are spaced apart from each other by a distance of about 3.25 inches. The length of the second sections 40 is between about 11 and 12 inches, and the length of the third section 50 is between about 2 and 3 inches, for example, 2½ inches. Further, the hook 10 is essentially rounded, with a radius of about 1 inch. Furthermore, the acute angle between the first section 30 and the third section 50 can be, for example, about 117 degrees.

It should be understood that the invention is not necessarily limited to the specific dimensions, arrangements, materials or other specifics shown and described above, but may be susceptible to numerous variations within the scope of the invention. For example, it is contemplated that the second ends 44 of the second sections 40 can be provided with a protective cap to cover any sharp edges that may be present, or that these ends may be bent in a U-shape so that the protruding end has a rounded configuration.

It will be apparent to one skilled in the art that the manner of making and using the claimed invention has been adequately disclosed in the above-written description taken together with the drawings.

It will be understood that the above description of the preferred embodiments are susceptible to various modifications, changes and adaptations, and the same are intended to be comprehended within the meaning and range of equivalence of the appended claims.

The invention claimed is:

1. In combination, a boot having an elongated neck that covers a leg of a user; and a hanger, the hanger comprising:

a hook; and at least two spaced-apart support arms, each support arm including:

a first section having a first end rigidly attached to a base of the hook, and having a second end, the first section extending at a downward slope, so that the second end is distal to an area under an opening of the hook; and a second section having a fixed end connected to the second end of the first section, the fixed end of the second section being disposed distal to the area under the opening of the hook, the second section also having a free end, the free end of the second section being disposed proximate to the area under the opening of the hook;

wherein the second sections of the support arms are spaced apart from each other, and are generally parallel to each other; and wherein the hook and the support arms accommodate the boot in an inverted manner, so that a heel of the boot is positioned in a region where the second section is connected to the first section, with the neck of the boot extending downward between the respective second sections, and with the second sections engaging respective opposing exterior sides of an upper of the boot to support the upper.

2. The combination recited in claim 1, wherein each support arm further includes a third section directly connecting the respective first section to the respective second section.

3. The combination recited in claim 1, wherein the hook and the support arms are comprised of stainless steel.

4. In combination:

a boot having an elongated neck that covers a leg of a user; and a hanger, the hanger comprising:

a hook; and at least two spaced-apart support arms, each support arm including:

a first section having a first end rigidly attached to a base of the hook, and a second end disposed distal from the hook, the first section extending at a downward slope from the base of the hook, so that when the hook is disposed to be a high point of the hanger, the second end is disposed lower than the first end; and a second section having a first end connected to the second end of the first section, and a second end disposed in a region approximately under the hook;

wherein the first sections of the support arms angle away from each other to collectively form an acute angle, with a vertex of the acute angle being at the base of the hook;

wherein the second sections of the support arms are spaced apart from each other at a generally constant distance, and are generally parallel to each other; and wherein the hook and the support arms accommodate the boot in an inverted manner, so that a heel of the boot is positioned in a region where the second section is connected to the first section and a toe of the boot is positioned in a region of the second ends of the second sections, with the a neck of the boot extending downward between the respective second sections, and with the second sections engaging respective opposing exterior sides of an upper of the boot to support the upper.

5. The combination recited in claim 4, wherein each support arm further includes a third section directly connecting the respective first section to the respective second section.

6. The combination recited in claim 5, wherein the third section forms a generally right angle with the second section, and an acute angle with the first section.

7. The combination recited in claim 6, wherein each of the first section, the second section and the third section are essentially straight.

8. The combination recited in claim 5, wherein the third section forms a curve, with one end of the curve being connected to the first section, and another end of the curve being connected to the second section.

9. The combination recited in claim 4, wherein each of the first section and the second section are essentially straight.

10. The combination recited in claim 4, wherein when the second sections are disposed in a horizontal plane, the hook is positioned so that an opening defined thereby is facing the horizontal plane, with each first end of each second section being disposed in a region that is not under the hook.

11. The combination recited in claim 4, wherein the hook and the support arms are comprised of stainless steel.

12. In combination:

a boot; and a hanger that receives the boot, comprising:

a hook having an opening, and defining a vertical plane; and at least two spaced-apart support arms, each support arm including:

a first section having a first end rigidly attached to a base of the hook, and a second end disposed distal from the hook, the first section extending at a downward slope relative to the base of the hook, so that when the hook is disposed to be a high point of the hanger, the second end is disposed lower than the first end; and a second section having a first end connected to the second end of the first section, and a second end disposed in a region approximately under the hook;

wherein the first sections of the support arms angle away from each other to collectively form an acute angle, with a vertex of the acute angle being at the base of the hook;

wherein the second sections of the support arms are spaced apart from each other at a generally constant distance, and are generally parallel to each other;

wherein when the second sections are disposed in a horizontal plane, the hook is positioned so that the vertical plane is perpendicular to the horizontal plane and so that the opening directly faces the horizontal plane, with each first end of each second section being disposed in a region that is not in the vertical plane of the hook; and wherein the hook and the support arms are formed from a continuous, bent steel rod.

13. The combination recited in claim 4, wherein the hook is welded to the support arms.

14. The combination recited in claim 4, wherein when the hanger is freely hanging, a region of the support arms where the first sections are connected to the second sections, is disposed lower than the second ends of the second sections.

15. The combination recited in claim 4, wherein when the hook and the support arms accommodate the inverted boot, and when the hanger is freely hanging, the toe of the boot is positioned higher than the heel of the boot.

16. The combination recited in claim 4, wherein the second sections are movable away from each other, to increase the constant distance therebetween, so as to accommodate different sized boots.

17. In combination:

a boot: and a hanger that receives the boot, comprising:

a hook having an opening, and defining a vertical plane; and at least two spaced-apart support arms, each support arm including:

a straight first section extending at a continuous, downwardly sloping constant angle, beginning from a base of the hook and extending away from the base of the hook, with no portion of the extending first section being under the hook; and a straight second section having an end connected to the first section, and extending toward an area under the hook;

wherein the second sections of the support arms are spaced apart from each other, and are generally parallel to each other;

wherein when the second sections are disposed in a horizontal plane, the hook is positioned so that the vertical plane is perpendicular to the horizontal plane and so that the opening directly faces the horizontal plane, with each end of each second section being disposed in a region that is not in the vertical plane of the hook; and wherein said spaced-apart support arms are permanently affixed to the base of the hook.

18. The combination recited in claim 1, wherein each second section has a length that is between about 11 and 12 inches.

* * * * *